US007286678B1

(12) United States Patent
Bächler et al.

(10) Patent No.: US 7,286,678 B1
(45) Date of Patent: Oct. 23, 2007

(54) HEARING DEVICE WITH PERIPHERAL IDENTIFICATION UNITS

(75) Inventors: Herbert Bächler, Meilen (CH); Christian Berg, Uerikon (CH)

(73) Assignee: Phonak AG, Stafa (CH)

( * ) Notice: Subject to any disclaimer, the term of this patent is extended or adjusted under 35 U.S.C. 154(b) by 553 days.

(21) Appl. No.: 09/610,284

(22) Filed: Jul. 6, 2000

Related U.S. Application Data

(63) Continuation of application No. PCT/CH98/00502, filed on Nov. 24, 1998.

(51) Int. Cl.
*H04R 25/00* (2006.01)

(52) U.S. Cl. ..... 381/314; 381/312; 381/323

(58) Field of Classification Search ..... 381/312–315, 381/320–321, 323; 710/62–65, 72–74; 370/351–352
See application file for complete search history.

(56) References Cited

U.S. PATENT DOCUMENTS

| | | | | | |
|---|---|---|---|---|---|
| 4,425,481 | A | * | 1/1984 | Mansgold et al. | 381/317 |
| 4,548,082 | A | * | 10/1985 | Engebretson et al. | 73/585 |
| 4,947,433 | A | | 8/1990 | Gebert | |
| 4,992,966 | A | * | 2/1991 | Widin et al. | 702/103 |
| 5,210,803 | A | | 5/1993 | Martin et al. | |
| 5,276,739 | A | * | 1/1994 | Krokstad et al. | 381/318 |
| 5,604,812 | A | * | 2/1997 | Meyer | 381/314 |
| 5,606,620 | A | * | 2/1997 | Weinfurtner | 381/314 |
| 5,687,241 | A | * | 11/1997 | Ludvigsen | 381/312 |
| 5,706,351 | A | * | 1/1998 | Weinfurtner | 381/314 |
| 5,717,770 | A | * | 2/1998 | Weinfurtner | 381/316 |
| 5,754,661 | A | * | 5/1998 | Weinfurtner | 381/316 |
| 5,838,806 | A | * | 11/1998 | Sigwanz et al. | 381/312 |
| 5,868,683 | A | * | 2/1999 | Protopapas et al. | 600/559 |
| 6,005,954 | A | * | 12/1999 | Weinfurtner | 381/312 |
| 6,035,050 | A | * | 3/2000 | Weinfurtner et al. | 381/313 |
| 6,044,163 | A | * | 3/2000 | Weinfurtner | 381/312 |
| 6,094,489 | A | * | 7/2000 | Ishige et al. | 381/60 |
| 6,157,727 | A | * | 12/2000 | Rueda | 381/312 |
| 6,234,979 | B1 | * | 5/2001 | Merzenich | 600/559 |
| 6,366,863 | B1 | * | 4/2002 | Bye et al. | 702/57 |

(Continued)

FOREIGN PATENT DOCUMENTS

| | | |
|---|---|---|
| EP | 0 341 995 | 11/1989 |

(Continued)

OTHER PUBLICATIONS

Potter, D; Implementation of a plug and play sensor system using IEEE P1451.4; Nov. 2001; Sensor for Industry, 2001; pp. 162-166.*

(Continued)

*Primary Examiner*—Curtis Kuntz
*Assistant Examiner*—P. Dabney
(74) *Attorney, Agent, or Firm*—Pearne & Gordon LLP

(57) ABSTRACT

Hearing aid fitted with a central processing unit (1) having peripherals (3E, 3A) connected to its input and output. Each peripheral includes an identification unit (5) having an output connected to a first input of a comparator (9). A second input of the comparator is connected to a read-only identification memory (11) containing identification features of the peripherals. An output of the comparator drives a configuration memory (15). As a result, the hearing aid self identifies its current configuration based on the identification of the peripherals.

16 Claims, 3 Drawing Sheets

U.S. PATENT DOCUMENTS 6,859,538 B1 * 2/2005 Voltz ..... 381/77

FOREIGN PATENT DOCUMENTS

EP 0 714 067 A2 5/1996

OTHER PUBLICATIONS

Lee, Kang; A standard in support of smart transducer networking; May 2000; Instrumentation and Measurement Technology Conference, 2000; pp. 525-528.*

Potter, D; Overview and applications of the IEEE P1451.4 smart sensor interface standard; Oct. 2002; Autotestcon proceedings, 2002; pp. 777-786.*

Bruel and Kjaer; Product Data—TEDS Editor for IEEE p1451.4 Transducers; Bruel and Kjaer; 2 pages.*

Potter, D; Smart plug and play sensors; Mar. 2002; Instrumentation and Measurement Magazine; vol. 5, Issue 1; pp. 28-30.*

IIEEE XPlore serch results page.*

Online Magazine "Sensors & Transducerrs" (S&T e-digest; No. 7, Jul. 2004.*

Vanlentino, Mark; PCB Piezotronics Vibration Division "Microphone Handbook".*

Camara, L; Instrumentation and Measurement TEchnology Conference, 2000. IMTC 2000. Proceedings of the 17th IEEE vol. 2, May 1-4, 2000 pp. 541-545 Complete IEEE 1451 node, STIM and NCAP, Implemented for a CAN network.*

Camara, L; IECON 02 Industrial Electronics Society, IEEE 2002 28th Annual Conference. vol. 4, Nov. 5-8, 2002 pp. 2898-2902. Smart transducer systems working in communication networks within the IEEE—1451 standard.*

□Johnson, Robert N; Woods, Stan; "Overview and Status Update for IEEE 1451.2", Presentation at Sensors Expo, May 9, 2000, pp. 1-37, (PDF, 172 k). Website: http://www.telemonitor.com/download.html.*

IIEEE XPlore serch results page, no date provided.

Vanlentino, Mark; PCB Piezotronics Vibration Division "Microphone Handbook", no date.

XP 000229348, 8028 Electronic Components & Applications 10 (1990) No. 1 Eindhove, NL, $I^2C$-bus control programs for consumer applications, Tjeu Horsch, pp. 17-20.

XP 000074049, 2087 Elektronik 38 (1989) Nov. 24, No. 24, Munchen, DE, Low-cost Schnittstelle für 8-Bit-Mikrocomputer, pp. 152-157.

* cited by examiner

HEARING DEVICE WITH PERIPHERAL IDENTIFICATION UNITS

This application is a continuation of prior International Application No. PCT/CH98/00502, which has an international filing date of Nov. 24, 1998.

BACKGROUND OF THE INVENTION

The present invention relates to a hearing aid defined in the preamble of claim 1 and to a method, defined in the preamble of claim 9, for manufacturing a hearing aid.

Hearing aids are exceedingly complex systems. To meet a user's particular needs, a large number of different variations of hardware configurations must be made available. As a result manufacture, marketing and hearing-aid fitting incur very high costs, for instance manufacture requires setting up numerous different hearing-aid configurations which must be appropriately labeled and monitored and marketing requires commensurate stocking, while hearing-aid fitting must match the user's particular needs and different procedures are required depending on the particular hearing-aid configurations.

BRIEF SUMMARY OF THE INVENTION

Starting with a hearing aid of the above cited kind, it is the objective of the present invention to solve this problem. For that purpose, at least some of the peripherals shall comprise an identifying unit of which the output is connected to the input of a comparator. An identification memory is connected to the input of said comparator. At its output, the comparator drives a configuration memory.

Because at least some, preferably all peripherals identify themselves and because the comparator—on the basis of the incoming identifications from the peripherals and following comparison with several possibilities of connecting such peripherals—shall store such a particular hardware configuration, the following significant advantages are attained:

Once assembled, the hearing aid is self-identifying in that by means of the comparator it has ascertained its configuration in terms of peripherals.

Because this self-identification requiring no writing—for instance on the packaging—circumvents sources of errors in production quality controls, in marketing and fitting the hearing aids, it being impossible to test, deliver or fit a hearing aid that would be of another peripheral configuration.

In a preferred embodiment of the present invention, the comparator output is connected to an operationally selective input at the signal processing unit. As a result only such processing is feasible at the signal processing unit—whether for operational purposes per se or already for implementation—which also are admissible for the actual system constellation at hand. Operational programs which for instance must be implemented in wireless manner can be tested in this way for the admissibility of the predominant system constellation.

A further preferred embodiment of the hearing aid of the invention sets up the connection between peripherals and the central signal processor by means of a bus and interfaces. It is clear that in a conventional hearing aid the central digital processing unit must be connected hardware to hardware to the particular peripherals. The more options there are regarding the peripherals, the more connections must be provided for the central processing unit. This number increasingly affects the required chip area of the cited signal processing unit, and this feature is exceedingly disadvantageous in the desired miniaturization of hearing aids. Because the cited connections take place through a bus and interfaces, it is feasible to minimize the number of those hardware connections which are used in the hardware configuration of the state of the art, and the signals applied to said connections can be recognized and interpreted in configuration-specific manner by the signal processing unit. Applicable peripherals include microphones etc, sensors in general, loudspeakers etc., actuators in general, transceivers, i.e. wireless transmitters and/or receivers, manually operated selection switches, loudspeaker volume controls (potentiometers), read-only memories for instance processing parameters for the signal processing unit, read/write memories for instance for processing protocols, etc.

These peripherals can be generically divided into a first category of audio signal components such as sensors, actuators, amplifiers, filters and into a second category of control components such as transceivers, selection switches, memories etc.

Preferably a first bus with first interfaces is used for the first category and a second bus with second interfaces is used for the second category. In a further preferred mode, the first interfaces are designed as at least three-wire interfaces, the second interfaces are designed as at least two-wire interfaces. Appropriate interfaces on one hand are $I^2S$ a three-wire interfaces and $I^2C$ two-wire interfaces, both marketed by Philips.

In principle however the hookup of signal-processing-unit/bus/peripherals also can be implemented by means of other interfaces, for instance AES-3 interfaces from the Audio Engineering Society and/or SPI Motorola interfaces.

The actual configuration also determines which signals are being transmitted to the central processing unit and hence which parameters. If peripheral identification is automated at the hearing aid of the invention, it will also be possible to automatically activate those signal processing configurations from a plurality of such which do correspond to the prevailing configuration with peripherals, or to drive them externally for instance using a transceiver, that is in wireless manner. As a result the problem of hearing-aid signal processing which does not at all correspond to the present configuration including peripherals shall be eliminated.

In a further preferred embodiment, the hearing aid of the invention comprises an output connected to the configuration memory at the hearing aid. In this way it is feasible—when hooking up the hearing aid to a computer-assisted fitting apparatus—that the hearing aid in its present configuration shall call up said apparatus and identify itself, whereby errors caused by erroneous hearing-aid assumptions shall be excluded. This communication as well may be wireless in that the cited output is provided by a transceiver.

A method of the invention for manufacturing a hearing aid is defined by the features of claim 10. Further preferred implementations of the manufacturing method of the invention are specified in the further claims.

BRIEF DESCRIPTION OF THE DRAWINGS

The invention is elucidated below in relation to the attached drawings.

DETAILED DESCRIPTION OF THE INVENTION

Figure 1:
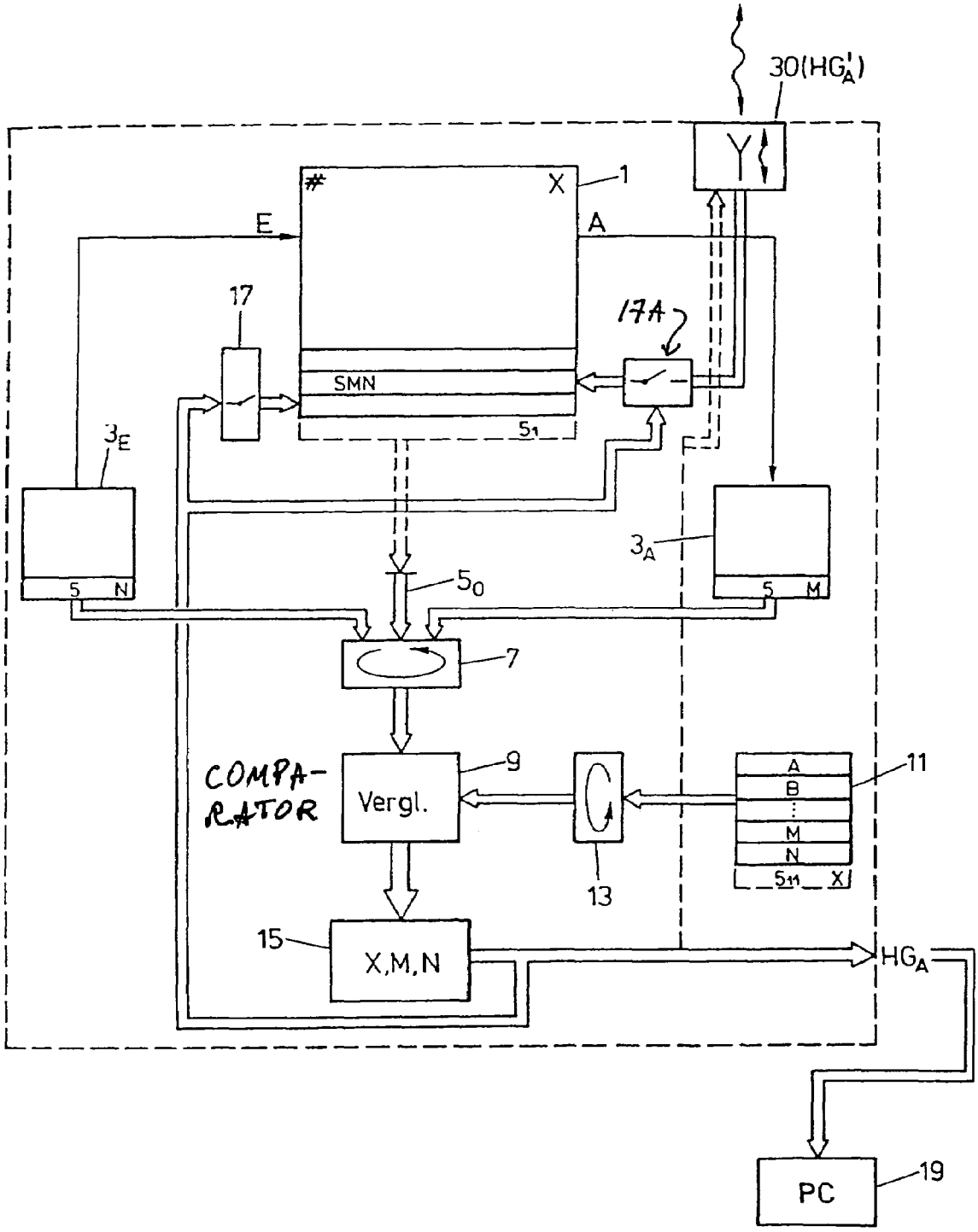
FIG. 1 is a signal-flow/functional-block diagram showing the basic principle of the hearing aid of the invention.

As shown in FIG. 1, a hearing aid of the invention comprises a central digital signal processing unit 1 having signal inputs E and signal outputs A. Peripherals $\mathbf{3}_E$ and $\mathbf{3}_A$ are connected to the signal inputs and outputs E and A. The peripherals $\mathbf{3}_E$ for instance may be sensors such as microphones, more generally acoustic/electric transducers, or control units such as a remote control with transceiver, program switches, a loudspeaker volume adjustment etc. As regards the peripheral $\mathbf{3}_A$, in particular actuators may be involved such as one or several electric/mechanical or electric/electric output transducers.

As shown in FIG. 1, at least one peripheral $\mathbf{3}_E$ is provided at the input side and at least one peripheral $\mathbf{3}_A$ at the output side of the signal processing unit 1. Digital and/or analogue inputs with subsequent analog/digital converters (omitted) are present at the central processing unit in relation to the signals transmitted by the peripherals $\mathbf{3}_E$. In similar manner digital outputs and/or analogue outputs preceded by digital/analog converters are present at the output side of said unit 1 in relation to the signals processed by the peripheral $\mathbf{3}_A$.

Each of the minimum of two peripherals 3 comprises an identification memory 5. The information stored in the identification memories 5 is highly specific to the kind of peripheral involved, for instance the kind of microphone, remote control etc.

Following hardware configuration of the hearing aid, an identification cycle begins. Therein, and as schematically indicated by the cycle unit 7, illustratively all identification memories 5 are searched sequentially and an appropriate determination is made that no peripherals are hooked up to the dummy connection $\mathbf{5}_r$. The unit 7 feeds the memory contents of the identification memories 5 to a comparator 9. All peripherals appropriate for the signal processing unit 1 together with their pertinent identifications are entered in a read-only memory 11.

To make sure that the signal processing unit 1 and the read-only memory 11 also correspond to each other in the sense that the memory 11 in fact does contain identification features of peripherals which also match the particular signal processing unit 1, the first step in identification may be in comparing and identification entry stored in an identification memory $\mathbf{5}_1$ of the signal processing unit 1 through the cycle unit 7 and the comparator 9 with the contents deposited at the read-only memory 11 in its own identification memory $\mathbf{5}_{11}$ and identifying this memory or contents.

As schematically indicated by the circulating unit 13, a sequential determination takes place at the comparator 9, by means of the entries in the identification memories 5 which of the kinds of peripherals 3 previously stored in the read-only memory 11 are at all present in the hearing-aid under consideration, and which are not. If there is a model X signal processing unit 1, and peripherals of types M and N are called for, then the output of the comparator stores the hearing aid configuration X, M, N in a hearing-aid configuration memory 15, and, as shown in relation to the read-only memory 11, further peripherals of types A, B etc. might be combined with the called-for X model signal processing unit 1.

The output of the configuration memory 15 drives the signal processing unit 1. In the light of the present hardware configuration as shown by the switch 17 in FIG. 1, a specific processing mode is activated at the signal processing unit 1, corresponding to $S_{MN}$, or is enabled. If the software of the processing mode has not yet been loaded into the signal processing unit 1, then, on account of the detected configuration in the configuration memory 15, the loading of processing modes software can be blocked when such modes are outside the called-for hearing-aid hardware configuration. If, as shown schematically in FIG. 1, a transceiver 30 is used, by means of which the signal processing unit 1 is loaded in wireless manner with the desired processing program, then, as diagrammatically shown at the switch 17*a*, implementation using the transceiver 30 shall be precluded if the implementation is tried for a processing mode other than for the X, M, N configuration.

The output of the configuration memory 15 preferably is connected to an output $HG_A$ of the hearing aid. When fitting the hearing aid to the patient, said output is fed to the PC supported fitting unit 19 whereby the hearing aid is identified by its individual configuration at the fitting unit 19. As shown in dashed lines, and in a preferred embodiment, the said output $HG_A$ can be implemented by the transceiver ($HG'_A$). Basically a transceiver 30 is needed and most advantageous, even mandatory for binaural signal processing. In such a design the two signal processing units 1 are able to communicate with each other, or, in preferred manner, binaural signal processing may be carried out in a common unit 1.

Figure 2:
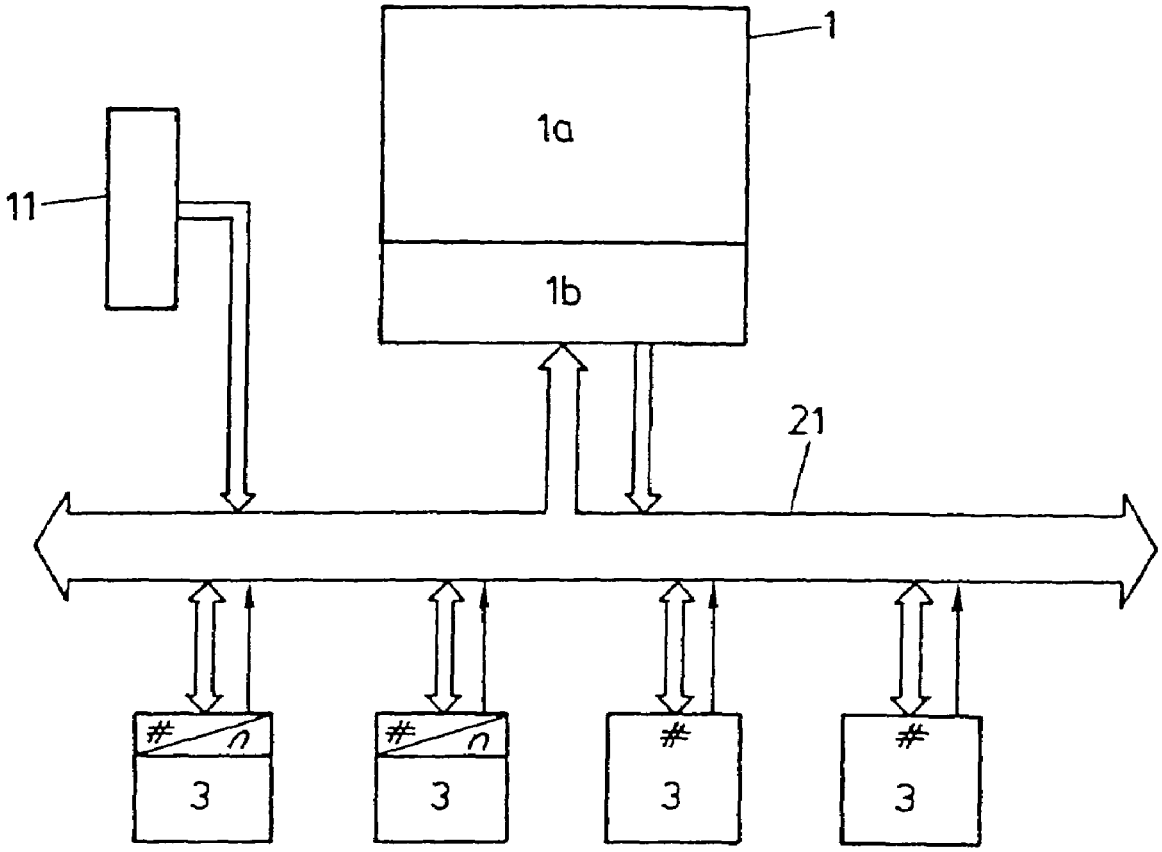
FIG. 2 shows a preferred design of the hearing aid of the invention.

In a further preferred embodiment shown in FIG. 2, the communication between a central processing unit 1 and peripherals 3, further with the read-only memory 11, for instance an EEPROM, and, as regards hearing-aid fitting, with an external fitting apparatus, can be basically implemented using a bus 21 and interfaces of the cited units. Preferably standard interfaces shall be used (omitted) in particular simple ones, and especially having only two- or three-signal lines such as and preferably $I^2C$ and $I^2S$ interfaces such as are presently marketed by Philips, or AES-3 interfaces (Audio-Engineering Society) or SPI interfaces (Motorola).

As further shown in FIG. 2, a two-way communications link is in place at least partly and by means of a bus 21 between the peripherals 3 and the central signal processing unit 1, whereby further specific values such as further configuration parameters, optional and/or revised data can be transmitted jointly with the component identification shown in FIG. 1 from the peripherals to the central processing unit, and from the central signal processing unit 1, data can be sent back to the peripherals. Preferably and as shown in FIG. 2, the central signal processing unit 1 includes a signal processing component $\mathbf{1}_a$ as well as controller component $\mathbf{1}_b$ which through the bus 21 controls and monitors the identification of configuration.

Figure 3:
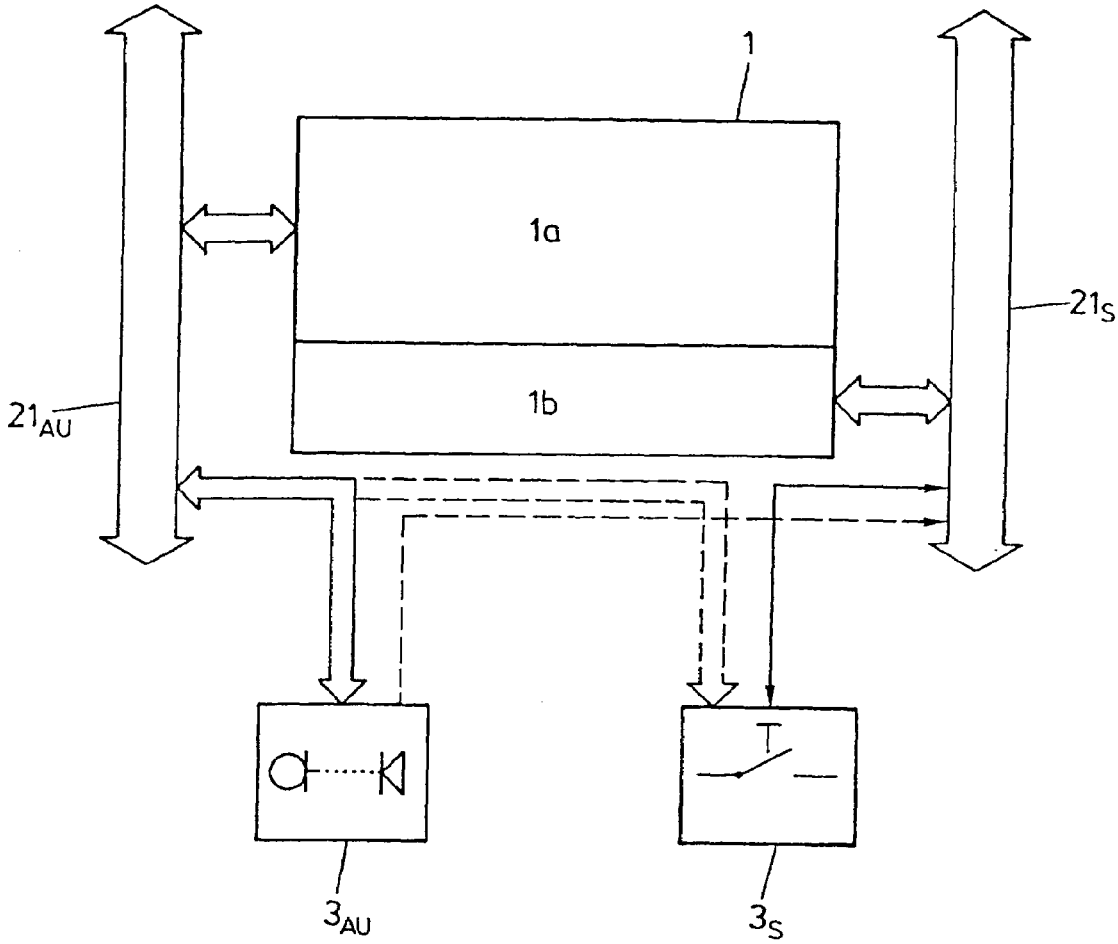
FIG. 3 shows a preferred embodiment of the invention's hearing aid designed as in FIG. 2.

FIG. 3 shows a preferred embodiment of the principle disclosed in FIG. 2. The peripherals basically are divided into audio-signal units or components $\mathbf{3}_{AU}$ and control units or components $\mathbf{3}_S$ and, depending on type, are treated as audio-signal components or pure control components or, in this respect, in a hybrid constellation. The audio components $\mathbf{3}_{AU}$ are connected through a first bus $\mathbf{21}_{AU}$ and (omitted) corresponding interfaces to the signal processing component 1*a* of the signal processing unit 1, whereas the control components $\mathbf{3}_S$ are connected through a second bus $\mathbf{21}_S$ to the control component 1*b* of the signal processing unit 1, again by means of corresponding interfaces. Preferably interfaces of different specifications are used for the connection between the audio components $\mathbf{3}_{AU}$, the bus $\mathbf{21}_{AU}$ and the signal processing component 1*a* than for the connection between the control components $3_S$, the bus $21_S$ are and for the controller component 1*b*.

Preferably three-wire interfaces preferably based on the $I^2S$ interfaces cited above are used for the former connection.

As regards the latter connection, namely the real control connection, preferably two-wire interfaces are used, in particularly preferably based on the above cited kind of $I^2C$ interfaces.

As shown in dashed lines, hybrid peripherals participating in the audio signal processing and being controlled and vice-versa, are each connected to the correspondingly preferred audio signal interfaces or control interfaces, additionally also to the second of the buses provided.

The module of the invention offers a real "plug and play" modular system for hearing aids allowing sharply lowering manufacturing costs, minimizing the connection configuration at the central signal processing unit and in particular substantially precluding erroneous packaging, erroneous configurations, mismatching etc. based on human inattentiveness.

The invention claimed is:

1. A hearing device comprising:

a digital signal processing unit having inputs and outputs;

self-contained hardware units, peripheral with respect to said digital signal processing unit and operationally connected to said inputs and outputs of said digital signal processing unit;

an identification unit in at least one of said peripheral self-contained hardware units, the identification unit having an output and containing identification information identifying said hardware unit;

a storage unit remote from said hardware unit containing identification information identifying more than one hardware peripheral unit and having an output;

a comparing unit remote from said hardware unit and having a first input, a second input, and an output, said output of said identification unit being operationally connected to the first input, and said output of said storage unit being operationally connected to the second input and a memory unit being operationally connected to the output of said comparing unit for storing the current configuration of said hearing device with respect to said peripheral self-contained hardware unit.

2. The device of claim 1, wherein the output of said comparing unit is operationally connected to a control input for the operation of said digital signal processing unit.

3. The device of claim 1, wherein said at least one of said self-contained peripheral hardware units and said digital signal processing unit is operationally connected via at least one data bus and interface unit.

4. The device of claim 1, further comprising an output of said device which is operationally connected to an output of said memory unit.

5. The device of claim 3, wherein said interface unit is one of a three-wire interface unit and a two-wire interface unit.

6. The device of claim 1, further comprising at least a second of said at least one self-contained hardware peripheral units, and wherein:

said one of said self-contained hardware peripheral units treating audio signal components of said device and being operationally connected to said digital processing unit via a first data bus with first interface units; and said second of said self-contained hardware peripheral units treating control signals of said hearing device and being operationally connected with said digital signal processing unit via a second data bus and second interface units.

7. The device of claim 1, wherein said at least one peripheral self-contained hardware unit treats audio signal components of said hearing device and is operationally connected to said digital signal processing unit via a data bus with at least three-wire interface units.

8. The device of claim 1, wherein said at least one hardware peripheral self-contained hardware unit treats control signals of said hearing device and is operationally connected to said digital signal processing unit via a data bus with two-wire interface units.

9. The device of claim 7, wherein said three-wire interface units are $I^2S$ units.

10. The device of claim 8, wherein said second interface units are $I^2C$ units.

11. The device of claim 1, wherein said one self-contained hardware peripheral unit is one of a sensor, an actuator, a transceiver, a manually operable selection switch unit, and a potentiometer.

12. The device of claim 4, wherein said output of said device is an output of a transceiver.

13. A method for manufacturing a hearing device, comprising the steps of:

providing a digital signal processing unit;

providing at least one self-contained peripheral hardware unit;

operationally connecting said peripheral self-contained hardware unit to said digital signal processing unit; and automatically identifying said peripheral self-contained hardware unit; and storing the current hardware configuration of the hearing device with respect to said peripheral units.

14. The method of claim 13, further comprising a step of selecting an operational mode of said signal processing unit as a function of said current hardware configuration.

15. The method of claim 13, further comprising a step of barring an operation of said digital signal processing unit which does not conform with said current hardware configuration.

16. The method of claim 13, further comprising a step of providing interpretation of signals towards and/or from said digital signal processing unit as a function of said current hardware configuration.

* * * * *

UNITED STATES PATENT AND TRADEMARK OFFICE

CERTIFICATE OF CORRECTION

PATENT NO. : 7,286,678 B1
APPLICATION NO. : 09/610284
DATED : October 23, 2007
INVENTOR(S) : Herbert Bächler et al.

It is certified that error appears in the above-identified patent and that said Letters Patent is hereby corrected as shown below:

On the Title page

Item (56), References Cited, Other Publications, please delete the following duplicate reference:

"Vanlentino, Mark; PCB Piezotronics Vibration Division 'Microphone Handbook"

On the Title page

Item (57), Abstract, line 2: please insert --respectively-- after the word "input"

Signed and Sealed this

Eighth Day of April, 2008

JON W. DUDAS
*Director of the United States Patent and Trademark Office*